US009586247B2

(12) United States Patent
Dueppers et al.

(10) Patent No.: US 9,586,247 B2
(45) Date of Patent: Mar. 7, 2017

(54) EXTRUSION PRESS AND TUBE PRESS AND METHOD FOR SEPARATING A BUTT

(71) Applicants: Hermann-Josef Dueppers, Neuss-Grimlinghausen (DE); Uwe Muschalik, Duisburg (DE)

(72) Inventors: Hermann-Josef Dueppers, Neuss-Grimlinghausen (DE); Uwe Muschalik, Duisburg (DE)

(73) Assignee: SMS GROUP GMBH, Moenchengladbach (DE)

( * ) Notice: Subject to any disclaimer, the term of this patent is extended or adjusted under 35 U.S.C. 154(b) by 150 days.

(21) Appl. No.: 14/232,523

(22) PCT Filed: Nov. 7, 2012

(86) PCT No.: PCT/EP2012/004629
§ 371 (c)(1),
(2) Date: Jan. 13, 2014

(87) PCT Pub. No.: WO2013/068105
PCT Pub. Date: May 16, 2013

(65) Prior Publication Data

US 2014/0250967 A1 Sep. 11, 2014

(30) Foreign Application Priority Data

Nov. 7, 2011 (DE) ..... 10 2011 117 730

(51) Int. Cl.
*B21C 35/04* (2006.01)
*B21C 23/21* (2006.01)

(52) U.S. Cl.
CPC ..... *B21C 35/04* (2013.01); *B21C 23/211* (2013.01)

(58) Field of Classification Search
CPC . B29C 47/0066; B29C 47/0038; B29C 47/00; B21C 35/04; B21C 23/21; B21C 35/02; B21C 35/00; B21C 35/023
See application file for complete search history.

(56) References Cited

U.S. PATENT DOCUMENTS 3,220,237 A 11/1965 Govan
4,424,696 A * 1/1984 Asari ..... B21C 23/211 72/272

(Continued)

FOREIGN PATENT DOCUMENTS

CN 201338027 Y 11/2009
CN 101596560 A 12/2009

(Continued)

OTHER PUBLICATIONS

Yamamoto et al. Original WIPO document WO2013061666 is attached which is family member of English equivalent US2014/0260488A1.*

(Continued)

*Primary Examiner* — A. Dexter Tugbang
*Assistant Examiner* — John S Lowe
(74) *Attorney, Agent, or Firm* — Andrew Wilford

(57) ABSTRACT

The invention relates to an extrusion press or tube press (1), in particular for aluminum or aluminum alloys, comprising a press frame which consists of a cylinder bar and a counter bar (3) connected thereto, and in which a moving bar and a moving block receiver (2) are arranged, the moving block receiver being formed to move a block to be pressed, introduced with a loading device, into a compression position in front of the counter bar (3) having a die, characterized in that a shearing device (4) is provided for separating a butt remaining after the extrusion process, and the shearing device (4) is vertically and horizontally movable on the extrusion frame. The invention further relates to a method (Continued)

for separating a butt during extrusion and tube extrusion using an extrusion press or tube press according to the invention.

6 Claims, 2 Drawing Sheets

(56) References Cited

U.S. PATENT DOCUMENTS

| | | | | |
|---|---|---|---|---|
| 7,448,245 | B2 † | 11/2008 | Muschalik | |
| 8,490,453 | B2 * | 7/2013 | Yamamoto | B21C 35/04 72/254 |
| 8,939,001 | B2 * | 1/2015 | Momo | B21C 35/04 72/255 |
| 2010/0263428 | A1 | 10/2010 | Yamamoto et al. | |
| 2014/0260488 | A1 * | 9/2014 | Masunaga | B21C 35/04 72/255 |

FOREIGN PATENT DOCUMENTS

| | | | | |
|---|---|---|---|---|
| CN | 201579298 | U | 9/2010 | |
| DE | 10231328 | A | 2/2004 | |
| EP | 1750865 | A | 2/2007 | |
| JP | WO 2013061666 | A1 * | 5/2013 | B21C 35/04 |
| WO | 2004/007107 | A1 | 1/2004 | |

OTHER PUBLICATIONS

Yamamoto et al. Original WIPO document WO2013061666 is attached, which is a family member of English equivalent US2014/0260488A1.*

* cited by examiner
† cited by third party

EXTRUSION PRESS AND TUBE PRESS AND METHOD FOR SEPARATING A BUTT

CROSS REFERENCE TO RELATED APPLICATIONS

This application is the US-national stage of PCT application PCT/EP2012/004629 filed 7 Nov. 2012 and claiming the priority of German patent application 102011117730.6 itself filed 7 Nov. 2011.

FIELD OF THE INVENTION

The invention relates to an extrusion and tube press comprising a press frame having a cylinder housing and a counter housing connected thereto and a moving bar and a moving billet holder that move a billet to be pressed and that has been set by a loader into a compression position in front of the counter housing having a die and on which a separation device is provided, in particular separation shears for performing a separating cut moving perpendicular to the extrusion direction past the mouth of the die for separating a butt. In addition, the invention relates to a method for separating a butt in extrusion and tube pressing using such an extrusion and tube press.

PRIOR ART

EP 1 750 856 B1 discloses one such extrusion and tube press and/or metal extrusion press of the type in question here, and DE 102 31 328 A discloses separation shears having a special blade with two cutting surfaces, the separating device being designed to be pivotable by a cylinder about a rotatable bearing, so that a smooth, clean separation cut can be achieved, optionally also with one end of the billet to be pressed and/or of the metal bolt protruding out of the billet holder, i.e., recipient.

Such extrusion presses and tube presses require a separation device, in particular a shear to separate the butt that unavoidably remains behind in extrusion pressing and that after the pressing operation projects out of the extrusion die that is arranged in or on the counter housing and to be able to continue the extrusion pressing or tube pressing of the following billet and/or metal bolt unhindered. Value is placed in particular on a clean separation cut for separating the butt in order to meet the quality demands of extrusion pressing of a plurality of billets and/or metal bolts.

The shear must be moved out of a starting position over a distance of usually more than 800 mm, vertically and orthogonally to the extrusion direction, in order to shear off the butt and be returned over the same distance back to its starting position. In addition, to reduce the wear between the separation device or the shear and the counter housing or the die mounted on it, the shear or at least a blade mounted on it or a shearing plate is pivoted back into its starting position before retraction.

However, this results in an extremely large installation space for the device and makes its structure complex. The plurality of movements required as well as the required vertical lift also result in an increased cost and idle time during which production by the extrusion and tube press is stopped.

OBJECT OF THE INVENTION

Therefore one object of the invention was to provide an extrusion or tube press which will not only permit an extremely clean separation cut with a very good shearing surface but will also permit shortened idle time and a reduced installation space.

SUMMARY OF THE INVENTION

According to a first aspect of the invention, a shear is provided for separating a butt remaining after the pressing operation, this shear being on the press frame so that it is vertically and horizontally displaceable. Because of the vertical and horizontal displaceability of the shear, the separation device and/or the separating shears must be raised out of the starting position only up to just above the extrusion die, in particular the pressure plate, of the die mount or the die and need not be raised above the billet holder (recipient). For the separating cut in the working position, the blade of the shear need only be lowered a slight distance so that the shear can be positioned accurately, preferably by a linear drive, and the butt can be sheared off smoothly.

The installation space of the extrusion or tube press can be reduced to the required minimum in this way, while at the same time shortening the idle time required for the shearing operation. At the same time, due to the vertical displacement of the shear, preferably at a right angle to the extrusion direction, an accurate separating cut can be performed. It is possible in particular to preferably omit the need to provide pivot drives for the shear or at least for its blades.

It is preferable if the horizontal displacement path of the shear is more than 100 mm, preferably between 150 or 250 mm, in particular preferably about 200 mm. This creates an extrusion or tube press that is capable of moving the shear horizontally away from the extrusion die and preferably raising it only vertically.

In another preferred embodiment of the invention, the vertical lift of the shear is set to be less than 600 mm, preferably less than 500 mm, in particular preferably between 450 and 500 mm. In this way, a definite reduction in the installation space is achieved in comparison with extrusion presses or tube presses having a vertical lift of usually more than 800 mm. It should be possible to move the shear upward, preferably out of the path of travel of the extrusion die and then to displace it horizontally so it is contact with the counter housing into a starting position above the extrusion die, preferably in contact with the counter housing. This creates a shear whose path from its starting position to a working position is optimally shortened and at the same time does not necessitate any restriction of the pressing operation itself. In this way, the idle time is ultimately also reduced to the required minimum.

In this context, it is preferred in particular if a hydraulic cylinder is provided for actuation of the vertical movement of the shear and/or if an electric drive is provided for inducing the horizontal movement. Such drives are capable of performing predetermined displacements in a short period of time and with accurate positioning. In addition, hydraulic cylinders in the extrusion presses or tube presses according to the invention may utilize the hydraulic equipment which is provided anyway and they are capable of applying the forces required for shearing off the butt.

According to another aspect of the invention, a method for separating a butt in extrusion and tube pressing using an extrusion or tube press according to the invention comprises at least the steps of compressing a workpiece from a billet holder against the counter housing, retracting the billet holder after this pressing back into its starting position, then vertically displacing the shear for shearing off the butt, vertically retracting the shear after shearing off the butt and horizontally displacing the shear into a starting position.

In this context, it is preferable if, after shearing off the butt and before the vertical retraction, the shear is displaced horizontally away from the billet holder. This horizontal displacement preferably amounts to at least 3 mm, in particular preferably 5 mm to 10 mm. This creates a method in which, while utilizing the ability of the device according to the invention to horizontally displace the shear, pivoting of the separation device away from the counter housing is no longer necessary. Instead, due to the horizontal displacement of the shear, the shear can be separated from the counter housing and the shear can be returned to its starting position without any interaction with the extrusion die or the counter housing.

In this context, it is preferable if the shear and in particular a cutting blade or a shearing plate of the shear is aligned parallel to the counter housing at least during the shearing operation. It is especially preferable if the shear is oriented parallel to the counter housing during the entire procedure. Therefore, a method is provided in which it is possible to completely omit pivoting of the shear or parts of the shear, while at the same time ensuring a precisely perpendicular separating cut when shearing off the butt.

Resetting of the shear back in its starting position is accomplished without the need for pivoting and while avoiding friction between the shear and the extrusion die or counter housing.

BRIEF DESCRIPTION OF THE DRAWING

The invention is explained in greater detail below with reference to four figures. These figures illustrate individual steps of a method according to the invention using a device according to the invention. In the figures.

SPECIFIC DESCRIPTION OF THE INVENTION

Figure 1:
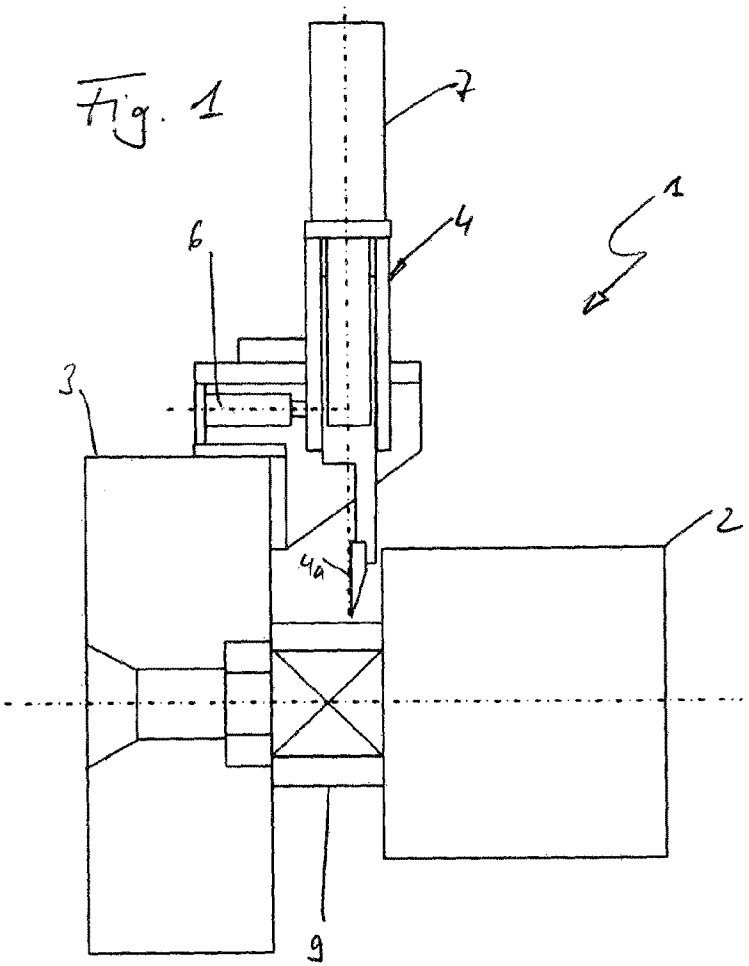
FIG. 1 shows an extrusion or tube press according to the invention, having a shear in the starting position.

FIG. 1 shows a schematic view of an extrusion or tube press 1 according to the invention in a starting position in which a shear 4 carrying a blade 4*a* is above an extrusion die 9 between a counter housing 3 and a billet holder 2. The billet holder 2 presses an unillustrated billet through the extrusion die 9 and the counter housing 3 to produce an extrusion. In this working position of the extrusion or tube press 1, the shear 4 remains in an upper position completely above the extrusion die 9 but only offset slightly toward the counter housing 3 in its starting position. The vertical and horizontal displaceability of the shear 4 in this embodiment is effected by a hydraulic displacement cylinder 7 as well as an electric drive 6.

Figure 2:
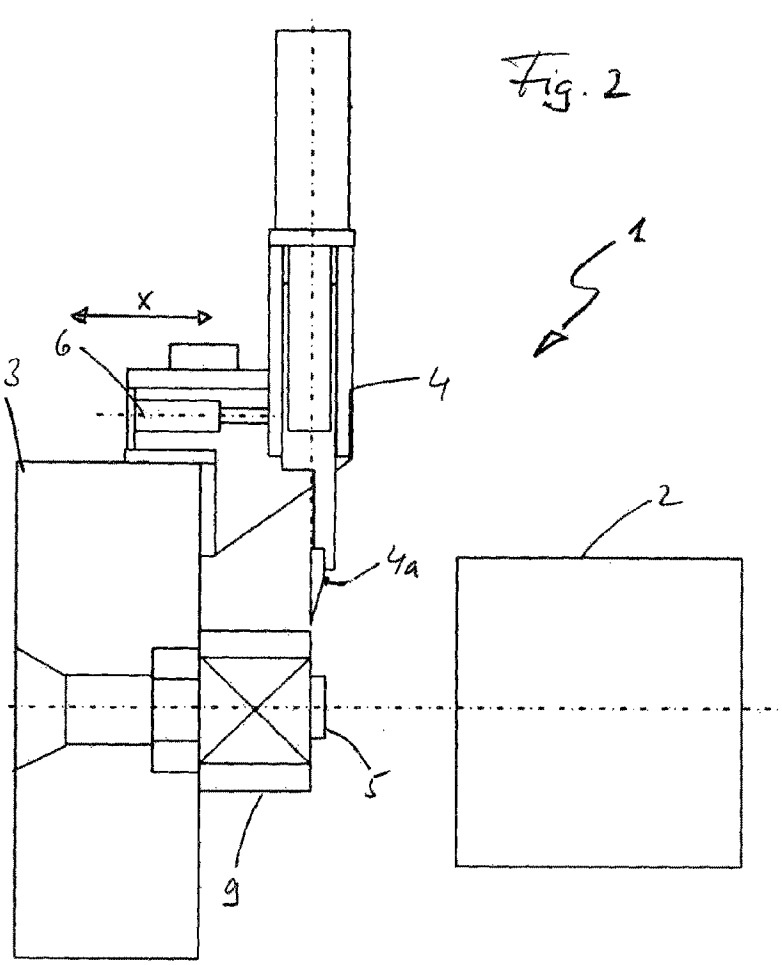
FIG. 2 shows the extrusion or tube press from FIG. 1 according to the invention, having a horizontally displaced shear.

FIG. 2 shows a first step in the method according to the invention, in which the shear 4 is displaced horizontally rearward in direction X (to the right in the figure) by the cylinder 6 into a position in which the shear 4, in particular the blade 4*a*, is aligned with the right rear face of the extrusion die 9 on the counter housing 3 with the workpiece butt 5 projecting rearward out past the rear face of the extrusion die 9. In this phase of the method according to the invention, the billet holder 2 has been displaced rearward to the right, opposite the direction of the extrusion press, to press another billet by extrusion onto the counter housing 3 and the die after separating the butt 5.

Figure 3:
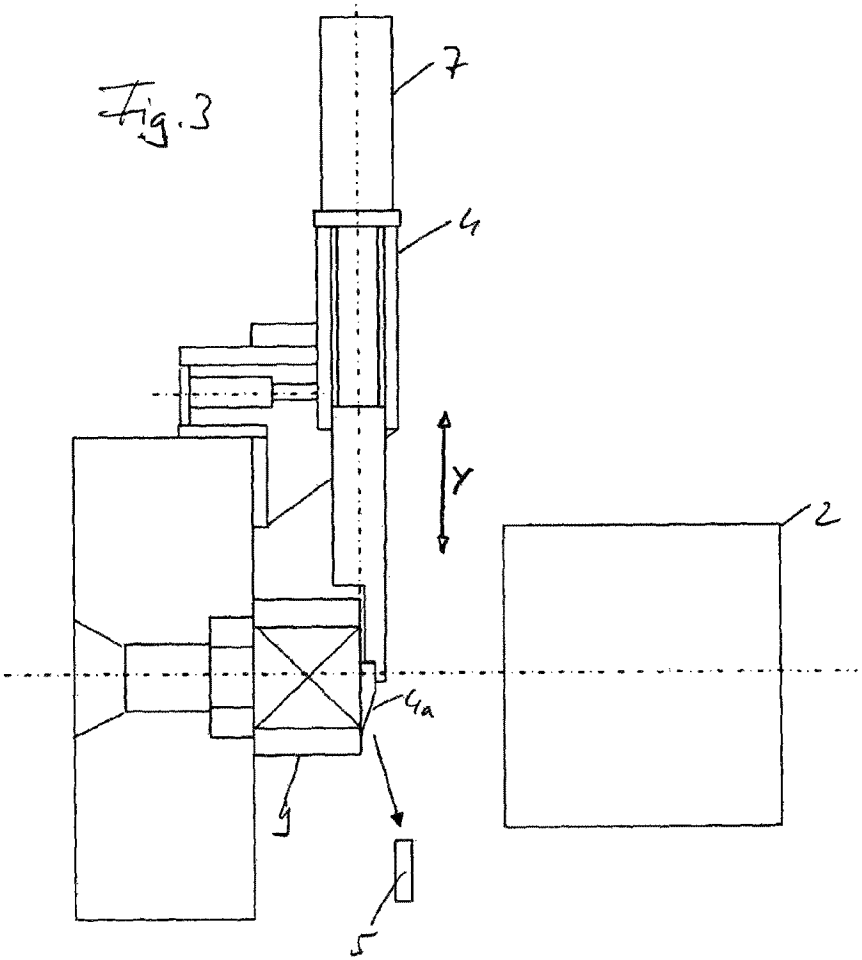
FIG. 3 shows the extrusion or tube press from FIGS. 1 and 2 according to the invention, after shearing off a butt.

FIG. 3 shows another step in the method according to the invention, in which the blade 4*a* of the shear 4 has been moved downward along the arrow Y by the hydraulic cylinder 7, so that the cutting edge of the cutting blade 4*a* passes downward along the right rear face of the extrusion die 9 exactly parallel to the extrusion die 9 and thus shears off the butt 5.

Figure 4:
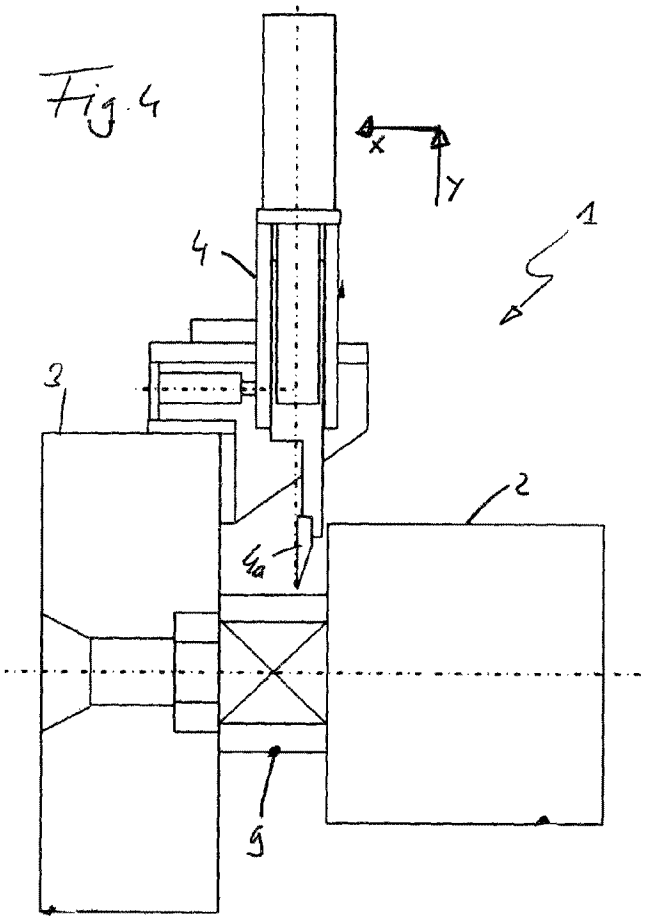
FIG. 4 shows the conclusion of the method according to the invention with the shear in its starting position.

Finally, FIG. 4, like FIG. 1, again shows the starting position of the extrusion or tube press 1 according to the invention in which the shear 4 has been displaced vertically upward along the arrow Y and horizontally forward to the left along the path X into the starting position toward the counter housing 3. The cutting blade 4*a* is above the extrusion die 9 and thus completely frees the travel path for the billet holder 2 toward the extrusion die 9 and the counter housing 3. It is therefore not necessary to raise the cutting device 4 beyond the position shown here or to pivot the cutting blade 4*a* out of the vertical position shown here.

The invention claimed is:

1. A method for separating a butt in extrusion and tube pressing using an extrusion or tube press having a counter housing, a die braced forward against the counter housing and having a rear face spaced in a rearward direction from and turned away from the counter housing, and a billet holder movable forward toward and rearward away from the rear face of the die, the method comprising the following steps:

pressing a workpiece forward from a starting position toward the billet holder past the rear face of the die and through the die against the counter housing while holding a shear in a rest position proximally forward of the rear face, above the die, but not above the billet holder, thereafter retracting the billet holder rearward into the starting position spaced rearward from the rear face, thereafter horizontally displacing the shear level with the rear face, thereafter vertically displacing the shear across the rear face for shearing off a butt, thereafter displacing the shear horizontally rearward away from the billet holder;

thereafter vertically retracting the shear above the die but not above the billet holder after shearing off the butt, and thereafter horizontally displacing the shear back into the rest position.

2. The method according to claim 1, wherein a horizontal displacement of at least 3 mm is performed after shearing off the butt.

3. The method according to claim 1, further comprising the step of:

aligning a blade or a shearing plate of the shear parallel to the counter housing at least during the shearing operation.

4. The method according to claim 3, wherein the blade or shearing plate of the shear is aligned parallel to the counter housing during the entire process.

5. The method defined in claim 1, further comprising the step of:

moving the shear only parallel and perpendicular to a direction of displacement of the billet holder in straight-line motion.

6. The method defined in claim 5, wherein a front face of the billet holder is of a greater dimension measured perpendicular to the direction of displacement than the rear face of the die.

* * * * *